US008238802B2

(12) United States Patent
Kawakami et al.

(10) Patent No.: US 8,238,802 B2
(45) Date of Patent: Aug. 7, 2012

(54) DEVELOPING UNIT, IMAGE RETAINER UNIT AND IMAGE FORMING APPARATUS

(75) Inventors: Tomoyuki Kawakami, Niigata (JP); Takafumi Wakai, Niigata (JP); Koichi Tanaka, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 410 days.

(21) Appl. No.: 12/551,862

(22) Filed: Sep. 1, 2009

(65) Prior Publication Data

US 2010/0124444 A1 May 20, 2010

(30) Foreign Application Priority Data

Nov. 17, 2008 (JP) ..... P2008-293483

(51) Int. Cl.
*G03G 15/08* (2006.01)

(52) U.S. Cl. ..... 399/281; 399/119; 399/254; 399/256; 399/263

(58) Field of Classification Search ..... 399/281, 399/119, 254, 256, 263
See application file for complete search history.

(56) References Cited

U.S. PATENT DOCUMENTS 7,072,594 B2 * 7/2006 Hoshi et al. ..... 399/119
2007/0196135 A1 * 8/2007 Fukuta ..... 399/254

FOREIGN PATENT DOCUMENTS

JP 2002-6708 1/2002
JP 3271848 B 1/2002

* cited by examiner

*Primary Examiner* — Ryan Walsh
(74) *Attorney, Agent, or Firm* — Morgan, Lewis & Bockius LLP

(57) ABSTRACT

A developing unit includes a developer receiving vessel and a developer conveyance member as defined herein, the developer conveyance member includes a rotary shaft, a first conveyance member and a second conveyance member as defined herein, the second conveyance member is supported on the rotary shaft and bent in contact with the wall surface of the developer receiving chamber with rotation of the rotary shaft while conveying the developer toward the developer retainer, and the second conveyance member includes a second conveyance member body supported on the rotary shaft and located out of the overlapping range, and a second overlapping portion extending from the second conveyance member body to the other axial end of the overlapping range, designed to be movable relatively to the rotary shaft and disposed adjacently to an upstream side of the first overlapping portion in a rotation direction.

15 Claims, 9 Drawing Sheets

DEVELOPING UNIT, IMAGE RETAINER UNIT AND IMAGE FORMING APPARATUS

CROSS-REFERENCE TO RELATED APPLICATIONS

This application is based on and claims priority under 35 USC 119 from Japanese Patent Application No. 2008-293483 filed on Nov. 17, 2008.

BACKGROUND

1. Technical Field

The present invention relates to a developing unit, an image retainer unit and an image forming apparatus.

2. Related Art

In an electrophotographic image forming apparatus such as a copying machine or a printer, an image is formed in such a manner that a latent image formed on a photoconductor surface is developed into a visible image by a developing unit and the developed visible image is transferred and fixed onto a medium. In the developing unit, a developer conveyance member or the like is disposed for conveying a developer while agitating the developer.

SUMMARY

According to an aspect of the invention, there is provided a developing unit including: a developer receiving vessel which includes a developer receiving chamber and a retainer receiving chamber, the developer receiving chamber receiving a developer, the retainer receiving chamber supporting a developer retainer and being connected to the developer receiving chamber, the developer retainer rotating while retaining the developer on its surface; and a developer conveyance member which is disposed in the developer receiving chamber and conveys the developer in the developer receiving chamber toward the developer retainer, the developer conveyance member including: a rotary shaft which extends along the developer retainer; a first conveyance member which extends from one axial end of a predetermined overlapping range on an axially inner side of the rotary shaft to the other axial end of the rotary shaft and which has flexibility, the first conveyance member being supported on the rotary shaft and bent in contact with a wall surface of the developer receiving chamber with rotation of the rotary shaft while conveying the developer toward the developer retainer, the first conveyance member including a first overlapping portion corresponding to the overlapping range; and a second conveyance member which extends from the other axial end of the overlapping range to the one axial end of the rotary shaft and which has flexibility, the second conveyance member being supported on the rotary shaft and bent in contact with the wall surface of the developer receiving chamber with rotation of the rotary shaft while conveying the developer toward the developer retainer, the second conveyance member including a second conveyance member body supported on the rotary shaft and located out of the overlapping range, and a second overlapping portion extending from the second conveyance member body to the other axial end of the overlapping range, designed to be movable relatively to the rotary shaft and disposed adjacently to an upstream side of the first overlapping portion in a rotation direction.

BRIEF DESCRIPTION OF THE DRAWINGS

Exemplary embodiments of the present invention will be described in detail based on the following figures, wherein:

FIGS. 3A and 3B are explanatory views of a developer conveyance member according to the first exemplary embodiment of the invention, in which FIG. 3A is an enlarged explanatory view of the developer conveyance member, and FIG. 3B is an enlarged explanatory view of the developer conveyance member, seen from a line IIIB in FIG. 3A;

FIGS. 4A and 4B are views for explaining the operation of the first exemplary embodiment, in which FIG. 4A is an explanatory view of the inside of a developing vessel, seen from above, immediately before toner conveyed by conveyance members which are bent is released to a connection portion, and FIG. 4B is an explanatory view of the conveyance members corresponding to FIG. 3B, seen from a line IVB in FIG. 4A;

FIGS. 5A, 5B, 5C and 5D are views for explaining the operation of the first exemplary embodiment, in which FIG. 5A is an enlarged explanatory view of the inside of the developing vessel V, seen from a line VA in FIG. 4A, FIG. 5B is an explanatory view of a state in which a rotary shaft has been rotated from the state of FIG. 5A so that either of the axially opposite end portions of the conveyance members has gotten over the left end of a bottom surface and released in the connection portion, FIG. 5C is an explanatory view of a state in which the rotary shaft has been rotated from the state of FIG. 5B so that the first conveyance member has gotten over the left end of the bottom surface and released in the connection portion, and FIG. 5D is an explanatory view of a state in which the rotary shaft has been rotated from the state of FIG. 5C so that the second conveyance member has gotten over the left end of the bottom surface and released in the connection portion;

FIGS. 6A and 6B are views for explaining a protrusion portion in a bottom surface according to a second exemplary embodiment of the invention, in which FIG. 6A is an enlarged explanatory view of a process cartridge according to the second exemplary embodiment of the invention, corresponding to FIG. 2 showing the first exemplary embodiment, and FIG. 6B is an enlarged explanatory view of a main portion of the protrusion portion, seen viewed from a line VIB in FIG. 6A;

FIGS. 7A and 7B are views for explaining a protrusion portion in a bottom surface according to a third exemplary embodiment of the invention, in which FIG. 7A is an enlarged explanatory view of a process cartridge according to the third exemplary embodiment of the invention, corresponding to FIG. 2 showing the first exemplary embodiment, and FIG. 7B is an enlarged explanatory view of a main portion of the protrusion portion, seen from a line VIIB in FIG. 7A;

FIGS. 8A and 8B are views for explaining a developer conveyance member according to a fourth exemplary embodiment of the invention, in which FIG. 8A is an enlarged explanatory view of the developer conveyance member, corresponding to FIG. 3A showing the first exemplary embodiment, and FIG. 8B is an enlarged explanatory view of the developer conveyance member seen from a line VIIIB in FIG. 8A, correspondingly to FIG. 3B showing the first exemplary embodiment.

DESCRIPTION OF REFERENCE NUMERALS AND SIGNS

Figure 1:
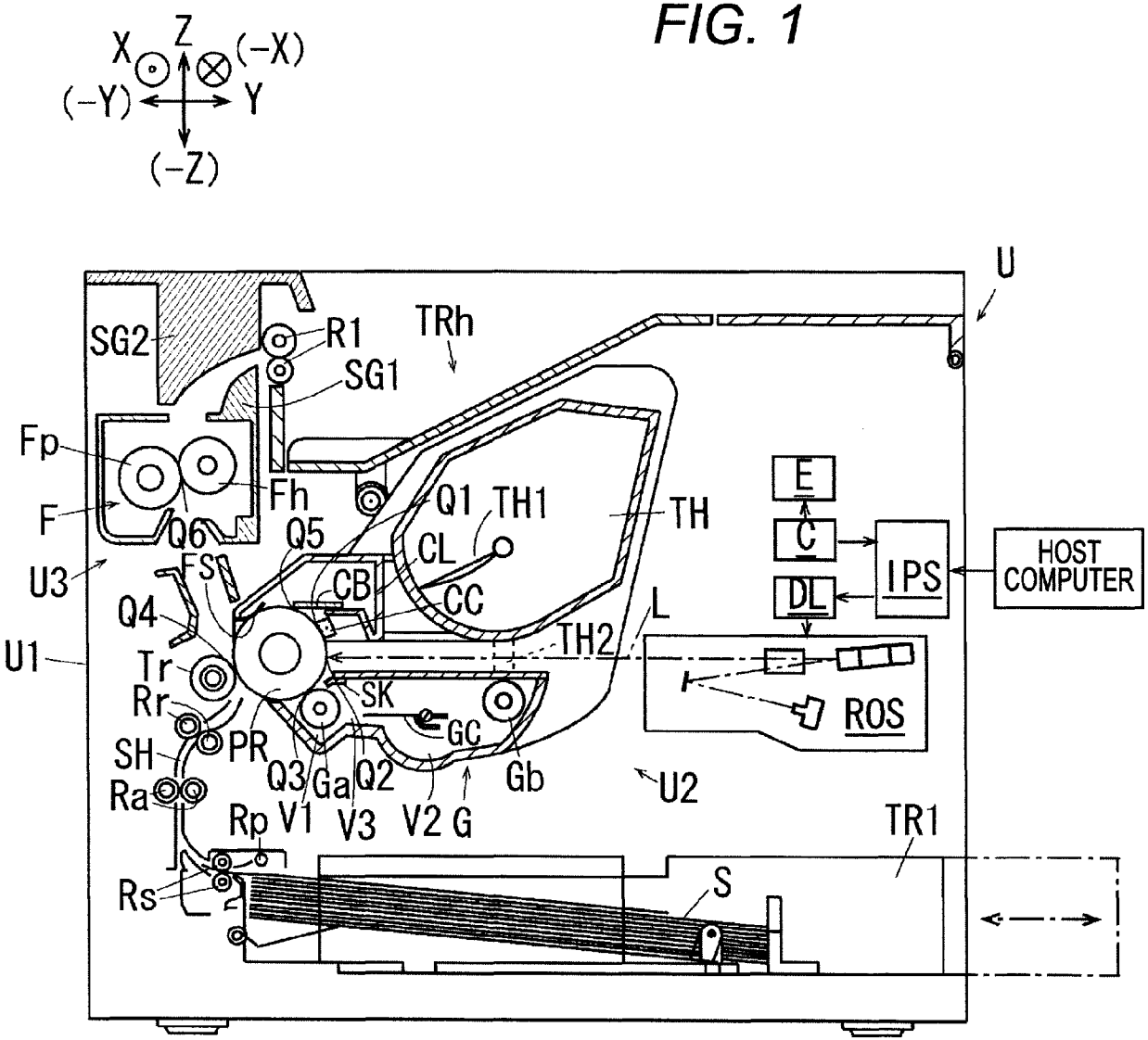
FIG. 1 is an overall view for explaining an image forming apparatus according to a first exemplary embodiment of the invention.

1 . . . rotary shaft, 2 . . . first conveyance member, 2*a*, 2*a*" , , , first conveyance member body, 2*b*, 2*b*" . . . first overlapping portion, 3 . . . second conveyance member, 3*a*, 3*a*" . . . second conveyance member body, 3*b*, 3*b*" . . . second overlapping portion, 4 . . . wall surface, 4*b*, 4*b*' . . . protrusion portion, 6 . . . gear, 7 . . . third conveyance member, 7*a* . . . third conveyance member body, 7*b* . . . first overlapped portion, 7*c* . . . second overlapped portion, 8 . . . elastic member, A . . . overlapping range, A1 . . . first overlapping range, A2 . . . second overlapping range, F . . . fixing unit, G, G', G" . . . developing unit, Ga . . . developer retainer, Gc . . . developer conveyance member, MO . . . driving member, PR . . . image retainer, S . . . medium, Tr . . . transferer, U . . . image forming apparatus, U2 . . . image retainer unit, V . . . developer receiving vessel, V1 . . . retainer receiving chamber, and V2 . . . developer receiving chamber.

DETAILED DESCRIPTION

Although specific exemplary embodiments of the invention (hereinafter referred to as "embodiments") will be described below with reference to the drawings, the invention is not limited to the following embodiments.

In order to facilitate understanding of the following description, in the drawings, the front/rear direction is indicated as an X-axis direction, the left/right direction is indicated as a Y-axis direction and the up/down direction is indicated as a Z-axis direction, and directions or sides designated by the arrows X, −X, Y, −Y, Z and −Z are indicated as the front direction, the rear direction, the right direction, the left direction, the upper direction and the lower direction, or the front side, the rear side, the right side, the left side, the upper side and the lower side respectively.

In the drawings, each arrow with "•" written in "○" is an arrow directed from the back side of the sheet to the front side thereof and each arrow with "x" written in "○" is an arrow directed from the front side of the sheet to the back side thereof.

In the following description using the drawings, any other member than members required for description is omitted from the drawings suitably for the purpose of facilitating understanding.

First Embodiment

FIG. 1 is an overall view for explaining an image forming apparatus according to a first embodiment of the invention.

In FIG. 1, a printer U as an image forming apparatus according to the first embodiment has a printer body U1, a process cartridge U2 and a fixing unit U3. The printer body U1 is an example of an image forming apparatus body. The process cartridge U2 is an example of an image retainer unit which is removably supported on the printer body U1.

The printer body U1 according to the first embodiment has a controller C, an image information conversion portion IPS (so-called Image Processing System), a laser drive circuit DL, a power supply unit E, etc. The controller C is an example of a control portion, which is constituted by a microcomputer. The operation of the image information conversion portion IPS is controlled by the controller C. The laser drive circuit DL is an example of a latent image forming unit drive circuit.

The power supply unit E applies bias voltages to a charging unit CC, a developing roller Ga, a transfer roller Tr, etc. which will be described later. The transfer roller Tr is an example of a transferee.

In addition, the image information conversion portion IPS converts print data into image data for forming a latent image. The print data is an example of print information, which is inputted from a host computer or the like as an example of an external information processing apparatus. The image data is an example of image information. The image information conversion portion IPS supplies the converted image data to the laser drive circuit DL at a predetermined timing. The laser drive circuit DL outputs a laser driving signal to a latent image writing unit ROS in accordance with the supplied image data. The latent image writing unit ROS is an example of a latent image forming unit.

Figure 2:
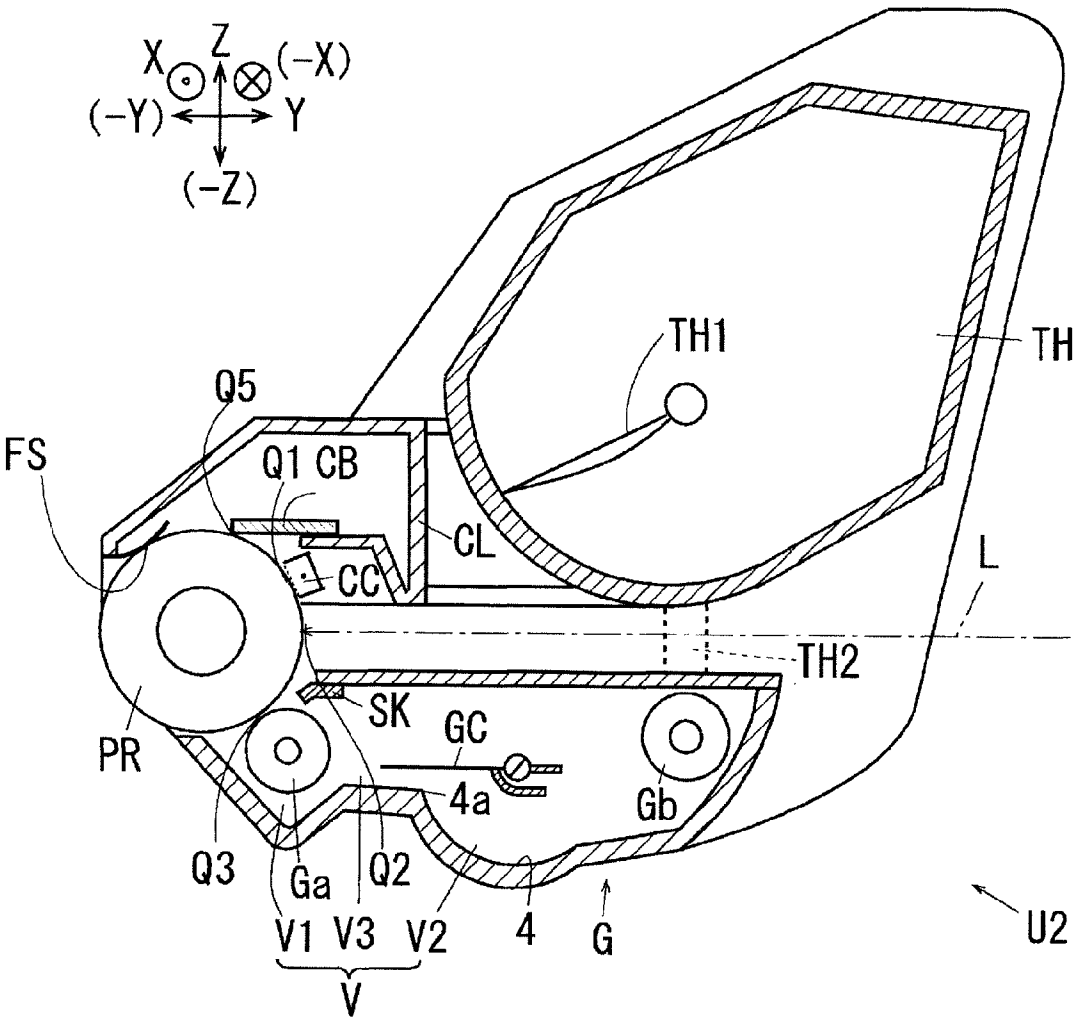
FIG. 2 is an enlarged view for explaining a process cartridge according to the first exemplary embodiment of the invention.

FIG. 2 is an enlarged view for explaining the process cartridge according to the first embodiment of the invention.

In FIGS. 1 and 2, the process cartridge U2 according to the first embodiment has an image retainer PR which is driven to rotate, the charging unit CC which is a so-called scorotron, a toner recovery vessel CL which is a so-called cleaner, a developing vessel V and a toner replenishment vessel TH. The toner recovery vessel CL is an example of a developer recovery vessel. The developing vessel V is an example of a developer receiving vessel. The toner replenishment vessel TH is an example of a developer replenishment vessel. Toner as an example of a developer to be replenished is received in the toner replenishment vessel TH. The toner is agitated by an agitation member TH1 and replenished to the developing vessel V through toner replenishment ports TH2 as examples of developer replenishment ports. The toner replenishment ports TH2 according to the first embodiment are disposed in the opposite, front and rear end portions of the toner replenishment vessel TH in order to avoid a path of a laser beam L which will be described later.

A retainer receiving chamber V1, a developer receiving chamber V2 and a connection portion V3 are provided internally in the developing vessel V. The retainer receiving chamber V1 disposed on the image retainer PR side. The developer receiving chamber V2 is connected to the toner replenishment ports TH2 of the toner replenishment vessel TH. The developer receiving chamber V2 receives toner replenished from the toner replenishment ports TH2. The connection portion V3 connects the receiving chambers V1 and V2 with each other. The developing roll Ga is rotatably supported in the retainer receiving chamber V1. The developing roll Ga rotates while retaining the toner on its surface. The developing roll Ga is an example of a developer retainer. A layer thickness limiting member SK for limiting the layer thickness of the developer on the surface of the developing roll Ga is provided above the developing roll Ga, that is, on the upstream side of the developing roll Ga in the rotation direction of the image retainer PR.

An inflow limiting member Gb and a developer conveyance member Gc are rotatably supported in the developer receiving chamber V2. The inflow limiting member Gb limits the inflow of the toner replenished from the toner replenishment ports TH2. The toner flowing into the developer receiving chamber V2 by the inflow limiting member Gb is conveyed toward the developing roll Ga by the developer conveyance member Gc.

The surface of the rotary image retainer PR is charged by the charging unit CC in a charging area Q1. In a latent image writing position Q2, an electrostatic latent image which is an example of a latent image is written in the surface of the image carrier PR by a laser beam L which is an example of latent image writing light emitted from the latent image writing unit ROS. The electrostatic latent image is developed into a toner image in a developing area Q3 by the developing roll Ga. The toner image is an example of a visible image. In a transfer area Q4 which is formed out of an area where the image retainer PR is brought into pressure contact with the transfer roll Tr, the toner image is transferred to a recording sheet S by the transfer roll Tr. The recording sheet S is an example of a medium. Residual toner on the surface of the image retainer PR is removed, that is, scraped off by a cleaning blade CB in a cleaning area Q5 which is an example of a cleaning area set on the downstream side of the transfer area Q4. The residual toner is an example of a residual developer. The cleaning blade CB is an example of a cleaning member. The removed toner is recovered into the toner recovery vessel CL. A film seal FS is provided oppositely to the cleaning blade CB. The film seal FS is an example of a developer leakage prevention member. The film seal FS prevents the toner recovered in the toner recovery vessel CL from spilling out therefrom.

Recording sheets S are taken out from a paper feed tray TR1 in a lower portion of the printer body U1 by a pickup roll Rp. The paper feed tray TR1 is an example of a paper feed vessel. The pickup roll Rp is an example of a medium taking-out member. Each recording sheet S separated one by one by a separating and feed roll set Rs is conveyed by sheet conveyance rolls Ra disposed along a sheet conveyance path SH. The separating and feed roll set Rs is an example of a medium separating and feeding member. The separating and feed roll set Rs includes a retard roll which is an example of a medium separation member and a feed roll which is an example of a medium feed member. The sheet conveyance rolls Ra are examples of medium conveyance members. The recording sheet S is conveyed to the transfer area Q4 at a predetermined timing by registration rolls Rr disposed on the upstream side of the transfer area Q4 in the sheet conveyance direction. The registration rolls Rr are examples of medium adjustment members.

A transfer bias is applied to the transfer roll Tr at a predetermined timing from the power supply unit E whose operation is controlled by the controller C. The transfer roll Tr applied with the transfer bias transfers the toner image on the image retainer PR to the recording sheet S passing through the transfer area Q4.

The recording sheet S to which the toner image has been transferred in the transfer area Q4 is conveyed to the fixing unit U3 in the condition that the toner image has not yet been fixed. The fixing unit U3 has a fixing device F consisting of a heating roll Fh and a pressure roll Fp opposed to the heating roll Fh. The heating roll Fh is an example of a heating fixing member, which heats the recording sheet S. The pressure roll Fp is an example of a pressure fixing member, which is brought into pressure contact with the heating roll Fh so as to apply pressure to the recording sheet S. A fixing area Q6 is formed out of a pressure contact area between the fixing members Fh and Fp. In the fixing area Q6, the toner image is heated and fixed to the recording sheet S conveyed to the fixing unit U3, by the fixing members Fh and Fp of the fixing device F. The recording sheet S having the fixed toner image formed thereon is guided by sheet guides SG1 and SG2 and discharged to a discharge tray TRh on the top of the printer body U1 through discharge rolls R1. The sheet guides SG1 and SG2 are examples of medium guide members. The output rolls R1 are examples of medium output members. The discharge tray TRh is an example of a medium discharge portion.

(Description of Developer Conveyance Member Gc)

Figure 3A:
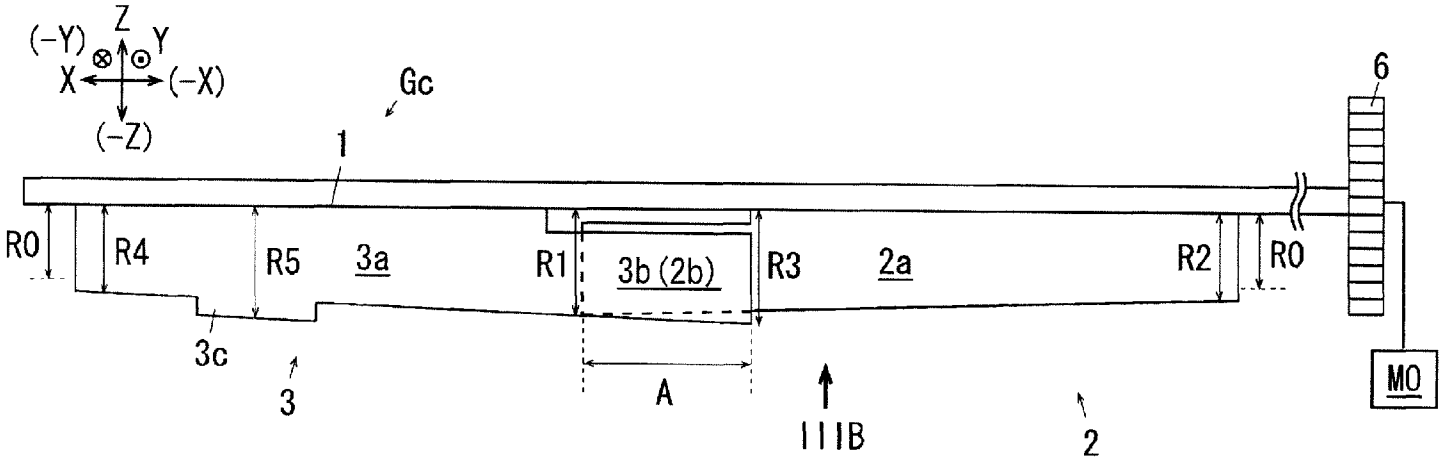
Figure 3B:
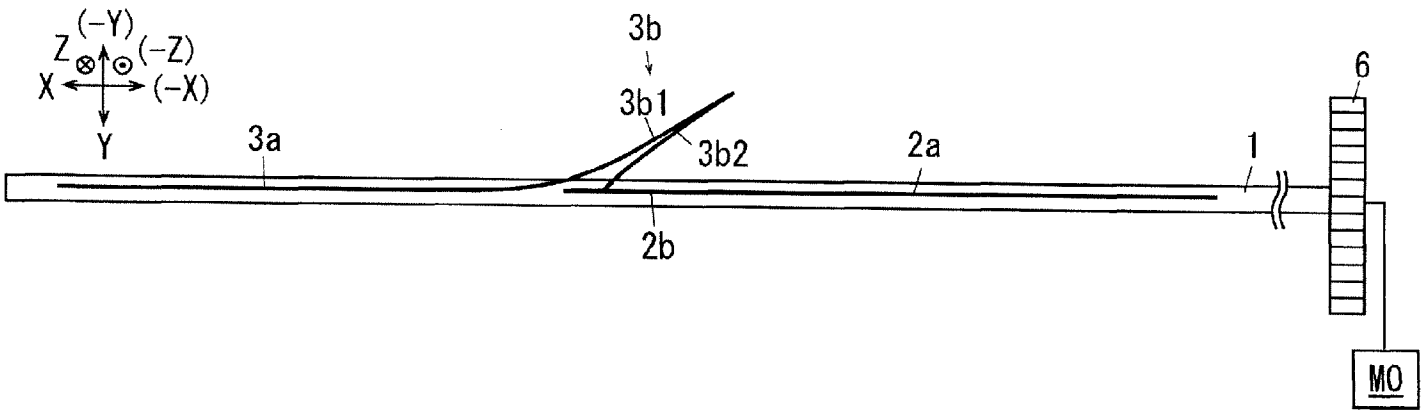

FIGS. 3A and 3B are explanatory views of the developer conveyance member according to the first embodiment of the invention. FIG. 3A is an enlarged explanatory view of the developer conveyance member. FIG. 3B is an enlarged explanatory view of the developer conveyance member, seen from a line IIIB in FIG. 3A.

In FIGS. 3A and 3B, the developer conveyance member Gc according to the first embodiment has a rotary shaft 1, a first conveyance member 2 and a second conveyance member 3. The rotary shaft 1 extends in the front/rear direction along the developing roll Ga. The first conveyance member 2 is supported on the rotary shaft 1 so as to extend from a rear end thereof to an axially central portion thereof in front of the rear end. The rear end is an example of the other axial end portion. The second conveyance member 3 is supported on the rotary shaft 1 so as to extend from a front end thereof to the axially central portion at the rear of the front end. The front end is an example of one axial end portion.

The conveyance members 2 and 3 according to the first embodiment extend radially outward from the rotary shaft 1. Each conveyance member 2, 3 is made of a thin-film member or a so-called film having flexibility. A resin material may be used for the conveyance members 2 and 3 in the first embodiment. For example, the conveyance members 2 and 3 may be made from polyethylene terephthalate or so-called PET.

The first conveyance member 2 according to the first embodiment has a first conveyance member body 2*a* and a first overlapping portion 2*b*. The first conveyance member body 2*a* is located on the rear side and supported on the rotary shaft 1. The first overlapping portion 2*b* extends forward from the front end of the first conveyance member body 2*a* and is designed to be movable relatively to the rotary shaft 1.

The second conveyance member 3 according to the first embodiment has a second conveyance member body 3*a* and a second overlapping portion 3*b*. The second conveyance member body 3*a* is located on the front side and supported on the rotary shaft 1. The second overlapping portion 3*b* extends rearward from the rear end of the second conveyance member body 3*a* and is designed to be movable relatively to the rotary shaft 1. A detection and cleaning portion 3*c* is disposed in a front portion of the second conveyance member body 3*a*. The detection and cleaning portion 3*c* is formed to have a radial length corresponding to a so-called toner sensor, which is a not-shown developer detection portion for detecting toner inside the developer receiving chamber V2.

As shown in FIG. 3B, the second overlapping portion 3*b* in the first embodiment includes a downstream oblique portion 3*b*1 and a folded portion 3*b*2. The downstream oblique portion 3*b*1 is disposed obliquely to extend from the downstream side of the rotary shaft to the upstream side of the rotary shaft so that the distance from the rotary shaft to the downstream oblique portion 3*b*1 increases gradually in a direction of going farther from the rear end toward the front end. The folded portion 3*b*2 extends forward from the rear end of the downstream oblique portion 3*b*1 and is folded back to the downstream side of the rotary shaft. The folded portion 3*b*2 is an example of an engagement portion. In the first embodiment, a front end portion of the folded portion 3*b*2 is in contact with the first overlapping portion 2*b* from the upstream side of the rotary shaft.

In addition, in the first embodiment, as shown in FIG. 3A, the second overlapping portion 3*b* is disposed adjacently to the right side of the first overlapping portion 2*b* when free end portions of the conveyance members 2 and 3 are disposed on the lower side. That is, an overlapping range A where the overlapping portions 2*b* and 3*b* are adjacent to each other and overlap each other is set in advance in an axially central portion of the rotary shaft 1 in the first embodiment.

The front end portion of the second overlapping portion 3*b* in the first embodiment is formed to extend forward beyond the overlapping range A.

Each conveyance member 2, 3 in the first embodiment is set in advance so that its radial length decreases gradually in a direction of going farther from its axially central portion toward each of its axially opposite end portions. That is, the conveyance members 2 and 3 are set in advance so that a relation of R1>R2 and a relation of R3>R5>R4 are established when R1 designates a radial length between a base end portion at the front end of the first conveyance member 2 and a free end portion thereof, R2 designates a radial length between a base end portion at the rear end of the first conveyance member 2 and the free end portion thereof, R3 designates a radial length between a base end portion at the rear end of the second conveyance member 3 and a free end portion thereof, R4 designates a radial length between a base end portion at the front end of the second conveyance member 3 and the free end portion thereof, and R5 designates a radial length between a base end portion of the detection and cleaning portion 3*c* and the free end portion of the second conveyance member 3. In the developer conveyance member Gc according to the first embodiment, the lengths R1 to R5 are set in advance to reduce differences among the lengths R1 to R5 so that the developer conveyance member Gc can be refrained from getting over the contact portion V3 and coming in contact with the developing roll Ga.

As shown in FIGS. 1 and 2, a bottom surface 4 which is an example of the wall surface of the developer receiving chamber V2 according to the first embodiment is formed into a semi-cylindrical shape which extends in the front/rear direction under the rotary shaft 1. The bottom surface 4 is set in advance so that a relation of R1>R2>R0 and a relation of R3>R5>R4>R0 are established when R0 designates a distance between the rotary shaft 1 and the bottom surface 4.

Therefore, when the rotary shaft 1 rotates to come into contact with the bottom surface 4, the axially central portion of the rotary shaft 1 is bent largely in comparison with the axially opposite end portions thereof. Thus, each conveyance member 2, 3 rotates and moves to advance more to the left, that is, to the downstream side of the rotation direction in a direction of going farther from the axially central portion toward each of the axially opposite ends. As a result, the toner flowing into the developer receiving chamber V2 and unevenly distributed to the axially opposite end portions thereof is moved toward the axially central portion so that the toner is distributed uniformly all over the axial range. The toner in this state can be easily conveyed by the developing roll Ga.

When each conveyance member 2, 3 bent due to its contact with the bottom surface 4 reaches a boundary 4*a* between the developer receiving chamber V2 and the connection portion V3, the conveyance member 2, 3 is released from bending and restored elastically. The boundary 4*a* is located in the downstream end of the bottom surface 4 in the rotation direction.

In FIGS. 3A and 3B, a driving gear 6 is supported on the rear end of the rotary shaft 1. The driving gear 6 is an example of a gear. The driving gear 6 according to the first embodiment is driven to rotate by a driving motor MO so as to rotate the rotary shaft 1. The driving motor MO is an example of a driving member.

A developing unit G according to the first embodiment is constituted by the developing vessel V, the developing roll Ga, the inflow limiting member Gb, the developer conveyance member Gc, the driving gear 6, the driving motor MO, etc.

Operation of First Embodiment

Figure 4A:
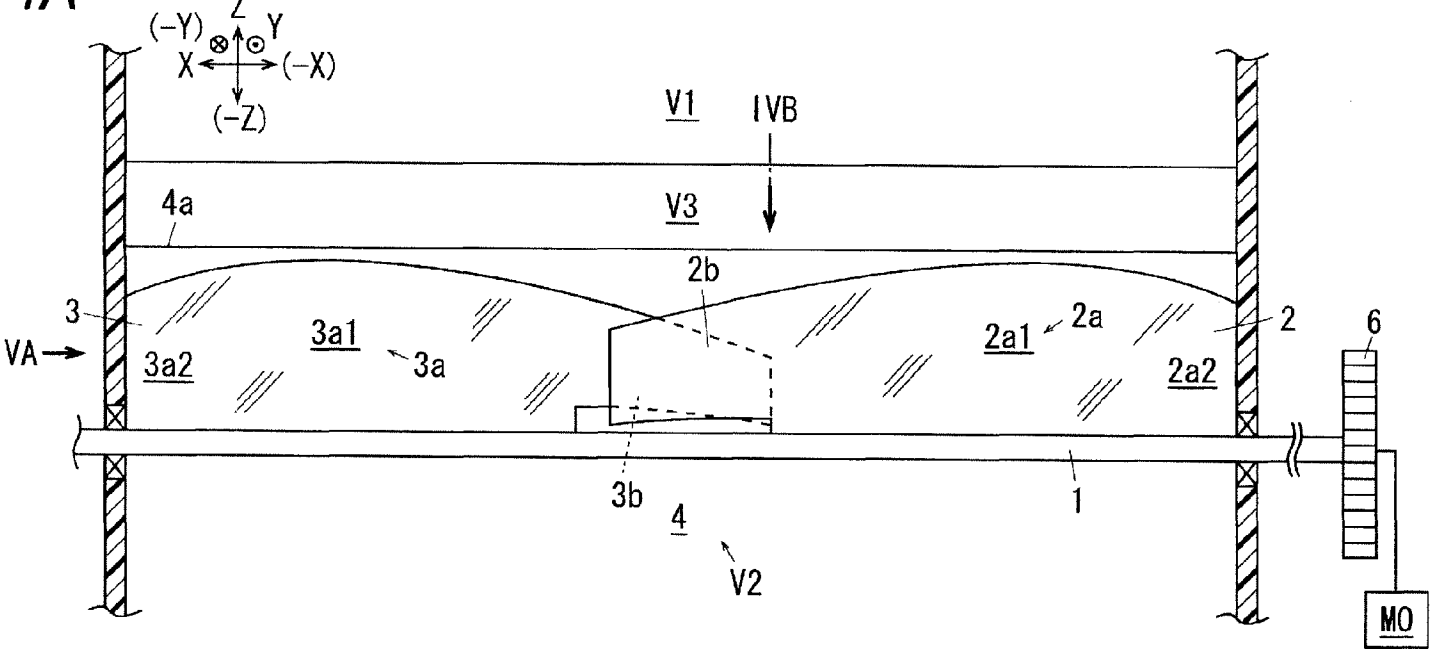
Figure 4B:
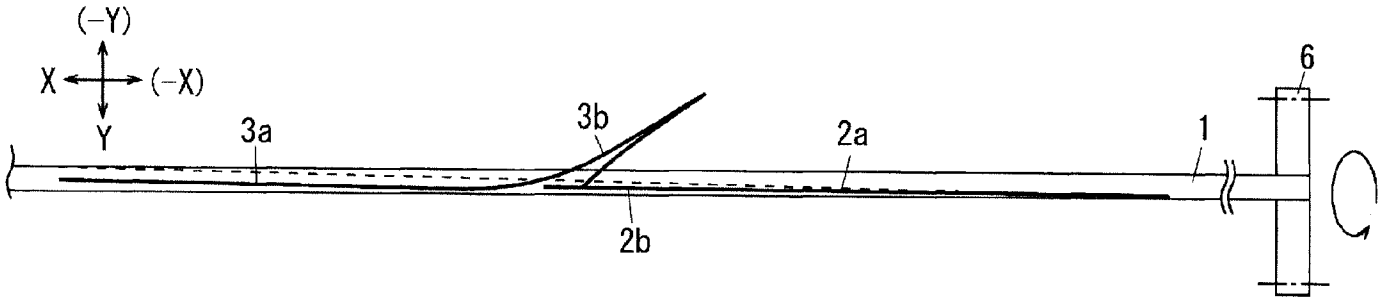

FIGS. 4A and 4B are views for explaining the operation of the first embodiment. FIG. 4A is an explanatory view of the inside of the developing vessel, seen from above, immediately before the toner conveyed by the conveyance members which are bent is released to the connection portion. FIG. 4B is an explanatory view of the conveyance members corresponding to FIG. 3B, seen from a line IVB in FIG. 4A.

Figure 5A:
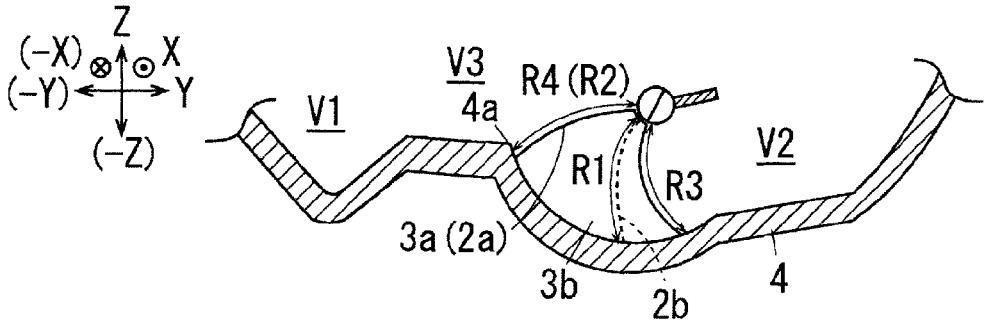
Figure 5B:
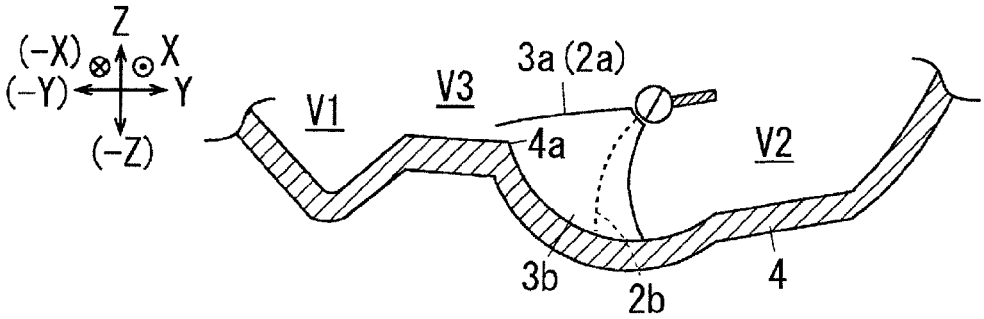
Figure 5C:
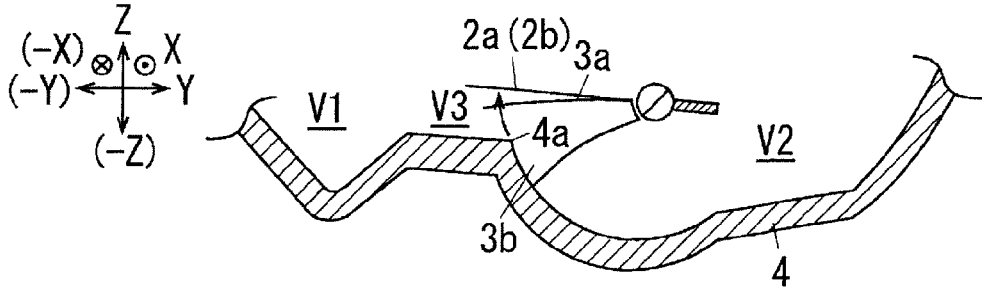
Figure 5D:
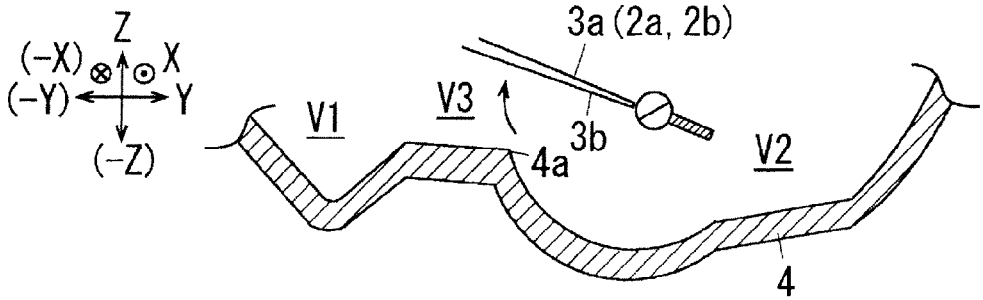

FIGS. 5A, 5B, 5C and 5D are views for explaining the operation of the first embodiment. FIG. 5A is an enlarged explanatory view of the inside of the developing vessel V, seen from a line VA in FIG. 4A. FIG. 5B is an explanatory view of a state in which the rotary shaft has been rotated from the state of FIG. 5A so that either of the axially opposite end portions of the conveyance members has gotten over the left end of the bottom surface and released in the connection portion. FIG. 5C is an explanatory view of a state in which the rotary shaft has been rotated from the state of FIG. 5B so that the first conveyance member has gotten over the left end of the bottom surface and released in the connection portion. FIG. 5D is an explanatory view of a state in which the rotary shaft has been rotated from the state of FIG. 5C so that the second conveyance member has gotten over the left end of the bottom surface and released in the connection portion.

When an image forming operation i.e. a so-called job is to be executed in the image forming apparatus U configured thus according to the first embodiment, the toner received in the toner replenishment vessel TH is replenished into the developing vessel V through the agitation member TH1 and the toner replenishment ports TH2.

The toner replenished into the developing vessel V flows into the developer receiving chamber V2 due to the inflow limiting member Gb, and then received in the developer receiving chamber V2. The toner received in the developer receiving chamber V2 is conveyed to the developing roll Ga in the retainer receiving chamber V1 through the connection portion V3 by the developer conveyance member Gc. When the rotary shaft 1 of the developer conveyance member Gc is rotated in the developer receiving chamber V2 according to the first embodiment, as shown in FIGS. 4A and 5A-5D, each conveyance member 2, 3 comes into contact with the bottom surface 4. Thus, the toner is conveyed by the conveyance member 2, 3 which is bent all over its axial range.

Here, in a conventional developer conveyance member in which a sheet of film is fixedly supported on a rotary shaft all over its axial range, the film is continuous to the axially opposite sides on the axially inner side of the rotary shaft. Thus, the film is restricted on the axially opposite sides when the film is being bent. The bending of the film is therefore apt to be small. On the contrary, the film is continuous only to one of in the axially opposite end portions of the rotary shaft. Thus, the film can be bent more easily than on the axially inner side. In the image forming apparatus U according to the first embodiment, the toner flowing in due to the inflow limiting member Gb is unevenly distributed to the axially opposite end portions. Therefore, also in view of the load of the toner, the axially opposite end portions of the film are apt to be bent greatly.

As a result, the film is bent more greatly and more easily in a direction of going farther from the axially inner side of the rotary shaft toward the axially outer side thereof. In this case, therefore, when the film gets over the boundary 4*a* shown in FIGS. 2, 4A and 5A-5D to be restored elastically with the rotation of the rotary shaft, the film is bent more easily in a direction of going farther from the axially central portion of the rotary shaft toward each axially outer end portion of the rotary shaft. On this occasion, a so-called air flow generated by the elastic restoration of the film is apt to travel from the axially central portion of the rotary shaft to the axially opposite end portions thereof. As a result, the air flow is refrained from travelling toward the axially outer ends by the outer wall of the developing vessel V supporting the rotary shaft on its axially opposite ends. Thus, the air flow is apt to be concentrated in gaps in the axially opposite end portions of the rotary shaft.

In the conventional developer conveyance member, therefore, toner is blown out with great force by the air concentrated in the axially opposite end portions of the rotary shaft. Thus, the toner may easily leak out of the developer vessel V through the axially opposite end portions of the rotary shaft of the developing roll Ga or may easily leak out to the axially outer side of the outer wall through a leakage prevention member i.e. a so-called seal member disposed in a position where the rotary shaft of the developing roll Ga is supported on the outer wall. As a result, the inside of the developing unit G, the process cartridge U2 or the image forming apparatus U, the sheet S, or the like, may be apt to be polluted by the toner leaking out.

However, the developer conveyance member Gc according to the first embodiment includes two films supported on the rotary shaft 1, that is, the conveyance members 2 and 3 shown in FIGS. 3A-3B, 4A-4B and 5A-5D. Therefore, when the film is elastically restored with the rotation of the rotary shaft 1 as shown in FIG. 4A, each of the two conveyance members 2 and 3 is bent more easily in a direction of going farther from its axially central portion 2*a*1, 3*a*1 toward its each axially outer end portion 2*a*2 or 2*b*, 3*a*2 or 3*b*. That is, according to the first embodiment, the axially opposite end portions 2*a*2 and 2*b*, 3*a*2 and 3*b* of the film which are easily bent are disposed in the axially opposite end portions 2*a*2 and 2*b*, 3*a*2 and 3*b* of each conveyance member 2, 3 respectively. Thus, the films are easily bent not only in the axially opposite end portions (2*a*2 and 3*a*2) of the rotary shaft 1 but also in the overlapping range A of the axially central portion (2*b* and 3*b*). Accordingly, the axially central portion (2*b* and 3*b*) of the rotary shaft 1 is bent as easily as the axially opposite end portions (2*a*2 and 3*a*2) of the rotary shaft 1. Thus, the film is apt to be elastically restored so late that the air flow generated by the elastic restoration is easily directed toward the axially opposite end portions (2*a*2 and 3*a*2) of the rotary shaft 1 and the axially central portion (2*b* and 3*b*) where the overlapping range A is disposed. Thus, the air flow can be dispersed easily.

In addition, the length of each of the two conveyance members 2 and 3 from the axially central portion 2*a*1, 3*a*1 to each axially outer end portion 2*a*2 or 2*b*, 3*a*2 or 3*b* becomes shorter than the length of the conventional conveyance member which is made of a sheet of film. Accordingly, the intensity of the air flow generated by the elastic restoration of the film is also relatively weaker in a direction of going farther from the axially central portion 2*a*1 or 3*a*1 of each conveyance member 2, 3 toward each axially outer end portion 2*a*2 or 2*b*, 3*a*2 or 3*b* thereof.

Further, according to the first embodiment, each overlapping portion 2*b*, 3*b* disposed in the overlapping range A is not supported on the rotary shaft 1, but is designed to be movable relatively to the rotary shaft 1. Accordingly, each overlapping portion 2*b*, 3*b* is apt to be delayed on the upstream side of the rotation direction in a direction of going farther from each conveyance member body 2*a*, 3*a* toward the axially central portion. Thus, the film in the overlapping range A is apt to be delayed on the upstream side in the rotation direction relatively to the films on the axially opposite end sides.

As a result, in the developer conveyance member Gc according to the first embodiment, the air flow is dispersed and weakened so that the toner can be relieved from being blown out violently in the axially opposite end portions of the rotary shaft 1, in comparison with the conventional developer conveyance member.

Accordingly, in the image forming apparatus U according to the first embodiment, the inside of each unit G, U2 or U, the sheet S or the like can be suppressed from being polluted by the toner blown out.

As shown in FIG. 3B, the second overlapping portion 3*b* according to the first embodiment is disposed in advance to be separated on the upstream side of the rotary shaft with respect to the first overlapping portion 2*b* by the downstream oblique portion 3*b*1 and the folded portion 3*b*2. In addition, as shown in FIGS. 3A-3B and 4A, the second overlapping portion 3*b* is formed to be long on the front side beyond the overlapping range A, that is, on the second conveyance member body 3*a* side. Thus, the axial length of the second overlapping portion 3*b* is set in advance to be longer than that of the first overlapping portion 2*b*. Accordingly, the second overlapping portion 3*b* is set in advance to be elastically restored later than the first overlapping portion 2*b*.

Here, when the rotary shaft 1 is rotated from the state shown in FIGS. 4A and 5A, the axially central portions 2*a*1 and 3*a*1 of the conveyance members 2 and 3 get over the boundary 4*a*, and then, the axially central portions 2*a*1 and 3*a*1 are elastically restored and released from bending. With the rotation of the rotary shaft 1, portions ranging from the axially central portions 2*a*1 and 3*a*1 to the axially opposite portions 2*a*2 and 3*a*2 get over the boundary 4*a* to be elastically restored in turn. Thus, as shown in FIG. 5B, each conveyance member body 2*a*, 3*a* is released from bending as a whole.

When the rotary shaft 1 is rotated from the state shown in FIG. 5B, the overlapping portion 2*b*, 3*b* of each conveyance member 2, 3 gets over the boundary 4*a* in turn from the conveyance member body 2*a*, 3*a* side, so as to be elastically restored. Thus, as shown in FIG. 5C, the first overlapping portion 2*b* is released from bending.

Further, when the rotary shaft 1 is rotated from the state shown in FIG. 5C, the second overlapping portion 3*b* of the second conveyance member 3 gets over the boundary 4*a* to be elastically restored so that the second overlapping portion 3*b* is released from bending, as shown in FIG. 5D.

Accordingly, in the image forming apparatus U according to the first embodiment, the axially central portions 2*a*1 and 3*a*1, the axially opposite portions 2*a*2 and 3*a*2 and the first overlapping portion 2*b* and the second overlapping portion 3*b* in the conveyance member bodies 2*a* and 3*a* are elastically restored and released from bending in turn and sequentially in the developer conveyance member Gc. As a result, the load of toner in each conveyance member 2, 3 is dispersed so that the toner can be further relieved from being blown out due to the elastic restoration of the conveyance member 2, 3, in comparison with the conventional developer conveyance member supported on the rotary shaft all over its axially whole range and elastically restored substantially at the same time.

When the rotary shaft 1 is rotated with the driving gear 6 disposed at the rear end of the rotary shaft 1 by the driving motor MO, the rotary shaft 1 suffers a reaction force from the conveyed toner, that is, a rotational resistance. Thus, the rear side of the rotary shaft 1 which is the driving side is distorted on the downstream side of the rotation direction relative to the front side of the rotary shaft 1 which is the driven side. Here, each of the two conveyance members 2 and 3 is formed so that the axial length supported on the rotary shaft 1, that is, the length between one axial end (2*a*2, 3*a*2) and the other axial end (2*b*, 3*b*) is shorter than that of the conventional conveyance member consisting of a sheet of film. Accordingly, the distortion of each conveyance member 2, 3 as shown in the solid line in FIG. 4B is relatively smaller than the distortion of the conventional conveyance member consisting of a sheet of film as shown by the broken line in FIG. 4B. As a result, due to the distortion, the second conveyance member 3 is relieved from being delayed on the upstream side in the rotation direction with respect to the first conveyance member 2.

Second Embodiment

Next, a second embodiment of the invention will be described. In the description of the second embodiment, constituent components corresponding to those in the first embodiment are referred to by the same numerals, and detailed description thereof will be omitted.

The second embodiment has the same configuration as the first embodiment, except the following points.

Figure 6A:
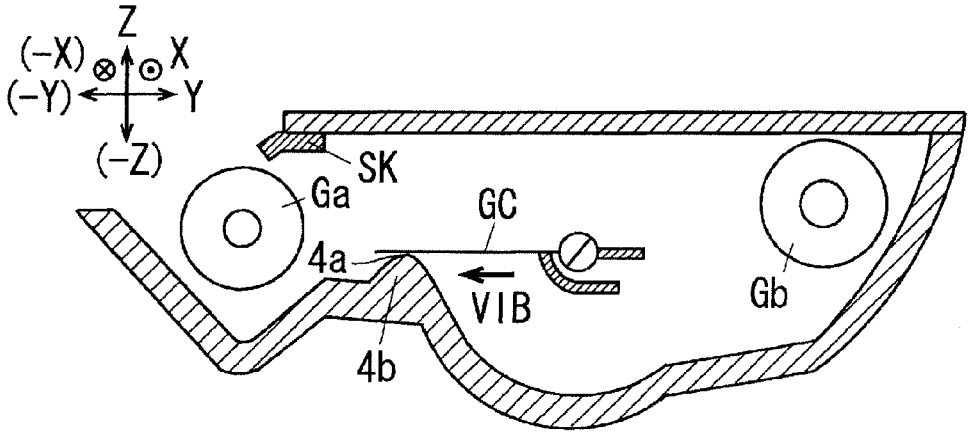
Figure 6B:
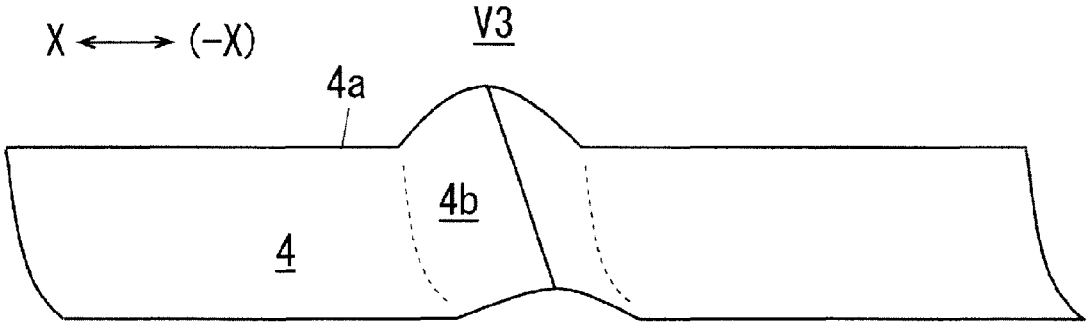

FIGS. 6A and 6B are views for explaining a protrusion portion in a bottom surface according to the second embodiment of the invention. FIG. 6A is an enlarged explanatory view of a process cartridge according to the second embodiment of the invention, corresponding to FIG. 2 showing the first embodiment. FIG. 6B is an enlarged explanatory view of a main portion of the protrusion portion, seen from a line VIB in FIG. 6A.

In FIGS. 6A and 6B, in the bottom surface 4 according to the second embodiment, a protrusion portion 4*b* extending from the boundary 4*a* toward the upstream side of the rotation direction is formed in a position corresponding to the axially central portion of the rotary shaft 1. The height of the protrusion portion 4*b* according to the second embodiment is set in advance to increase gradually in a direction of going farther from the upstream side of the rotation direction toward the boundary 4*a*. That is, in the second embodiment, as shown in FIG. 6A, the radial distance between the rotary shaft 1 and an upper end of the protrusion portion 4*b* is set in advance to be the shortest on the boundary 4*a*.

Operation of Second Embodiment

In the image forming apparatus U configured thus according to the second embodiment, when the rotary shaft 1 is rotated in response to an executed job, the conveyance members 2 and 3 which are in a bent state move on the bottom surface 4 from the upstream side of the rotation direction to the boundary 4*a*. On this occasion, the overlapping portions 2*b* and 3*b* in the overlapping range A are further bent when the overlapping range A shown in FIGS. 3A-3B and 4A-4B passes on the protrusion portion 4*b* shown in FIGS. 6A-6B. Accordingly, the overlapping portions 2*b* and 3*b* are delayed on the upstream side of the rotation direction in comparison with the conveyance member bodies 2*a* and 3*a* respectively. Thus, the overlapping portions 2*b* and 3*b* are restored later. As a result, in the image forming apparatus U according to the second embodiment, the timing for blowing out the toner due to the elastic restoration of the conveyance members 2 and 3 is apt to be dispersed axially.

The protrusion portion 4*b* according to the second embodiment is formed to be higher in a direction of going farther from the upstream side of the rotation direction toward the boundary 4*a*, so that the radial distance from the rotary shaft 1 is the shortest on the boundary 4*a*. Thus, the overlapping portions 2*b* and 3*b* are delayed on the upstream side of the rotation direction immediately before they are elastically restored. That is, the overlapping portions 2*b* and 3*b* according to the second embodiment are elastically restored surely later than the conveyance member bodies 2*a* and 3*a* respectively.

The other operation and effect of the image forming apparatus U according to the second embodiment is similar to that of the image forming apparatus U according to the first embodiment.

Third Embodiment

Next, a third embodiment of the invention will be described. In the description of the third embodiment, constituent components corresponding to those in the first or second embodiment are referred to by the same numerals, and detailed description thereof will be omitted.

The third embodiment has the same configuration as the first or second embodiment, except the following points.

Figure 7A:
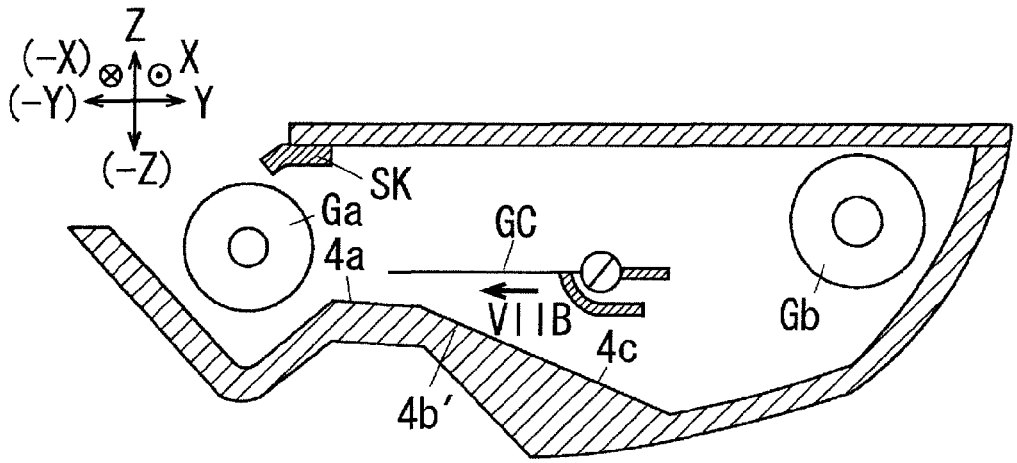
Figure 7B:
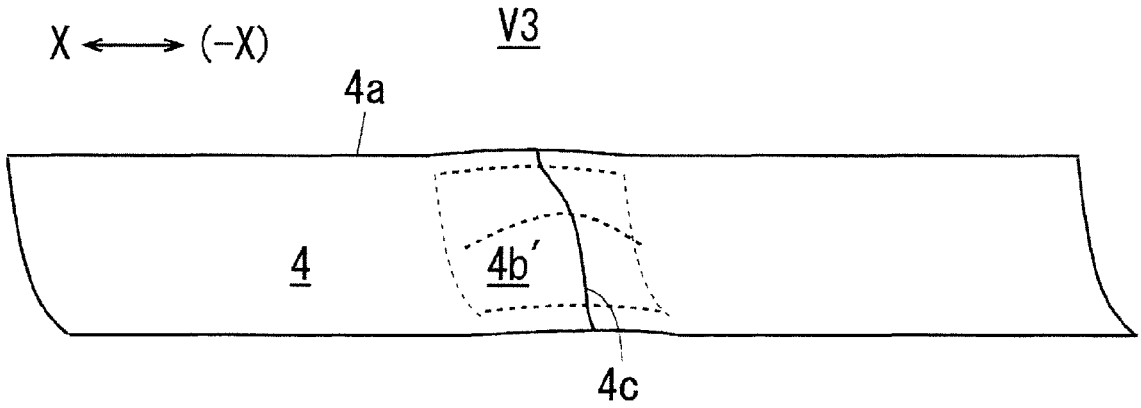

FIGS. 7A and 7B are views for explaining a protrusion portion in a bottom surface according to the third embodiment of the invention. FIG. 7A is an enlarged explanatory view of a process cartridge according to the third embodiment of the invention, corresponding to FIG. 2 showing the first embodiment. FIG. 7B is an enlarged explanatory view of a main portion of the protrusion portion, seen from a line VIIB in FIG. 7A.

In FIGS. 7A and 7B, the bottom surface 4 according to the third embodiment has a protrusion portion 4*b*' extending from the boundary 4*a* toward the upstream side of the rotation direction. The protrusion portion 4*b*' is formed to be longer than the protrusion 4*b* according to the second embodiment. A slope 4*c* inclined from the boundary 4*a* toward the upstream side of the rotation direction is formed on an upper end of the protrusion portion 4*b*' according to the third embodiment. That is, the height of the protrusion portion 4*b*' according to the third embodiment is set in advance so as to be highest in its central portion in the rotation direction and to decrease gradually in a direction of going farther from the central portion in the rotation direction toward any of the opposite end portions in the rotation direction. Thus, according to the third embodiment, the radial distance between the rotary shaft 1 and the upper end of the protrusion portion 4*b*' is set in advance to be shortest on the upstream side of the boundary 4*a* in the rotation direction.

Operation of Third Embodiment

In the image forming apparatus U configured thus according to the third embodiment, when the rotary shaft 1 is rotated in response to an executed job, the overlapping range A shown in FIGS. 3A-3B and 4A-4B passes on the protrusion portion 4*b*' shown in FIGS. 7A-7B. Accordingly, the overlapping portions 2*b* and 3*b* in the overlapping range A are delayed on the upstream side of the rotation direction with respect to the conveyance member bodies 2*a* and 3*a* respectively. Thus, the overlapping portions 2*b* and 3*b* are elastically restored later. As a result, the timing for blowing out the toner due to the elastic restoration of the conveyance members 2 and 3 is apt to be dispersed axially.

As shown in FIG. 7A, the protrusion portion 4*b*' according to the third embodiment is formed to be lower in a direction of going farther from its central portion in the rotation direction toward its opposite end portions in the rotation direction, so that the radial distance from the rotary shaft 1 is the shortest on the upstream side of the boundary 4*a* in the rotation direction. Thus, the overlapping portions 2*b* and 3*b* according to the third embodiment are bent more greatly in a direction of going farther from the upstream side of the protrusion portion 4*b*' in the rotation direction toward the central portion in the rotation direction. Thus, each overlapping portion 2*b*, 3*b* is elastically restored surely later. In addition, the overlapping portions 2*b* and 3*b* are bent less in a direction of going farther from the central portion of the protrusion portion 4*b*' in the rotation direction toward the boundary 4*a*. Thus, the elastic repulsion due to the elastic restoration of the overlapping portions 2*b* and 3*b* is reduced. As a result, the intension of the air flow generated by the elastic restoration of the developer conveyance member Gc according to the third embodiment can be reduced in comparison with that of the developer conveyance member Gc according to the second embodiment.

The other operation and effect of the image forming apparatus U according to the third embodiment is similar to that of the image forming apparatus U according to the first embodiment.

Fourth Embodiment

Next, a fourth embodiment of the invention will be described. In the description of the fourth embodiment, constituent components corresponding to those in the second embodiment are referred to by the same numerals, and detailed description thereof will be omitted.

The fourth embodiment has the same configuration as the second embodiment, except the following points.

Figure 8A:
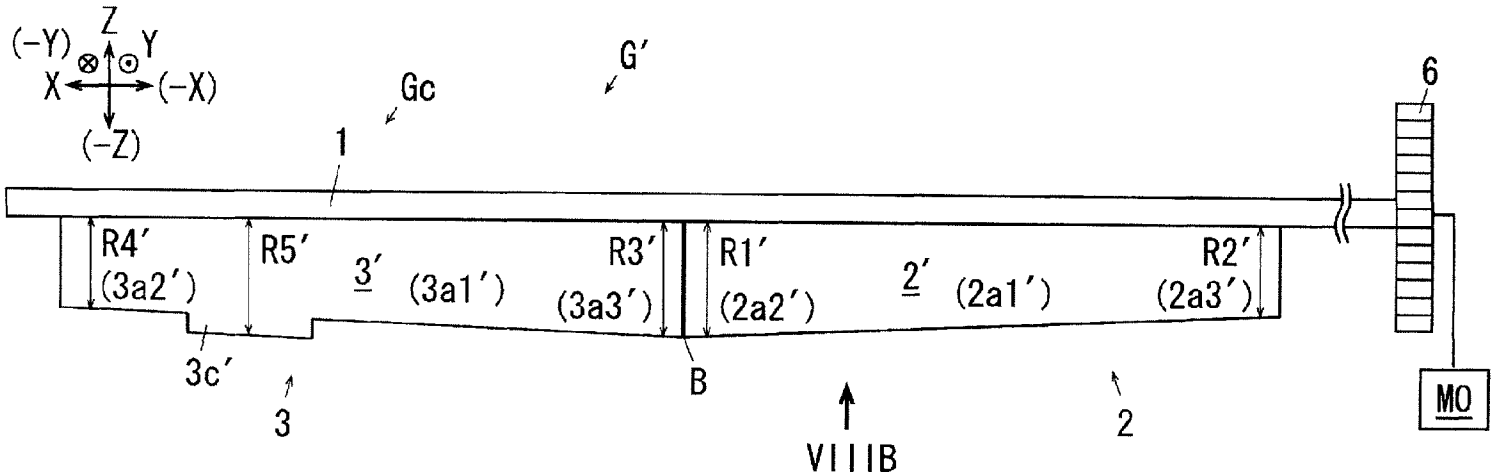
Figure 8B:
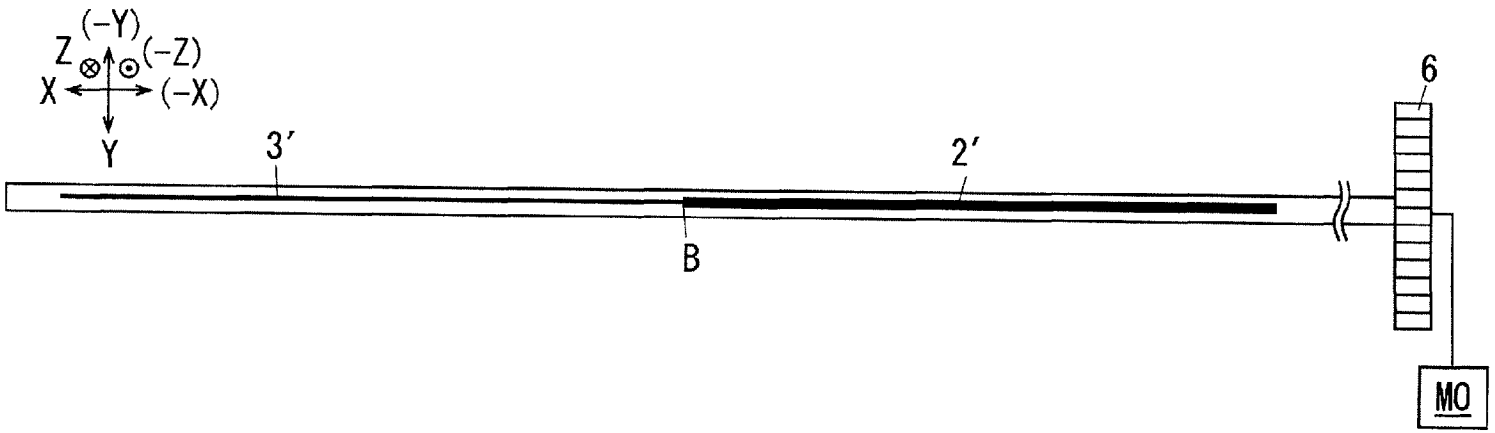

FIGS. 8A and 8B are views for explaining a developer conveyance member according to the fourth embodiment of the invention. FIG. 8A is an enlarged explanatory view of the developer conveyance member, corresponding to FIG. 3A showing the first embodiment. FIG. 8B is an enlarged explanatory view of the developer conveyance member, seen from a line VIIIB in FIG. 8A. FIG. 8B is an explanatory view corresponding to FIG. 3B showing the first embodiment.

In FIGS. 8A and 8B, the developer conveyance member Gc according to the fourth embodiment has a first conveyance member 2' and a second conveyance member 3' in place of the conveyance members 2 and 3 in the second embodiment. The first conveyance member 2' is supported on the rotary shaft 1 so as to extend from the rear end thereof to the axially central portion thereof. The second conveyance member 3' is supported on the rotary shaft 1 so as to extend from the front end of the axially central portion to the front end of the rotary shaft 1. Each conveyance member 2', 3' according to the fourth embodiment is made of a flexible film in the same manner as each conveyance member 2, 3 according to the second embodiment. However, as shown in FIG. 8B, the film of the first conveyance member 2' is formed to be thicker than that of the second conveyance member 3'.

The overlapping portions 2*b* and 3*b* of the conveyance members 2 and 3 according to the second embodiment are omitted in the conveyance members 2' and 3' according to the fourth embodiment respectively. That is, in the developer conveyance member Gc according to the fourth embodiment, the overlapping range A according to the second embodiment is replaced by a notch portion i.e. a so-called slit B which corresponds to a gap between the conveyance members 2' and 3'.

In addition, the second conveyance member 3' according to the fourth embodiment has a detection and cleaning portion 3*c*' which is similar to the detection and cleaning portion 3*c* of the second conveyance member 3 according to the second embodiment.

In the same manner as each conveyance member 2, 3 according to the second embodiment, each conveyance member 2', 3' according to the fourth embodiment is set in advance so that the radial length decreases gradually in a direction of going farther from the axially central portion toward any of the axially opposite end portions. That is, the conveyance members 2' and 3' are set in advance so that a relation of R1'>R2'>R0 and a relation of R3'>R5'>R4'>R0 are established when R1' designates a radial length at the front end of the first conveyance member 2', R2' designates a radial length at the rear end of the first conveyance member 2', R3' designates a radial length at the rear end of the second conveyance member 3', R4' designates a radial length at the front end of the second conveyance member 3', and R5' designates a radial length of the detection and cleaning portion 3*c*'.

A developing unit G' according to the fourth embodiment is constituted by the developing vessel V, the developing roll Ga, the inflow limiting member Gb, the developer conveyance member Gc, etc.

Operation of Fourth Embodiment

In the image forming apparatus U configured thus according to the fourth embodiment, when the rotary shaft 1 is rotated in response to an executed job, the conveyance members 2' and 3' which are in a bent state move on the bottom surface 4 from the upstream side of the rotation direction to the boundary 4*a*. The slit B shown in FIGS. 8A-8B passes on the protrusion portion 4*b* shown in FIGS. 6A-6B. Thus, the axially inner side of each conveyance member 2', 3' is bent more largely than the axially outer side thereof. In each conveyance member 2', 3', a portion which is closer to the axially outer side is elastically restored later than a portion which is closer to the axially inner side. As a result, in the same manner in the first to third embodiments, the axially central portions (2*a*3' and 3*a*3') of the rotary shaft 1 are bent as easily as the axially opposite end portions (2*a*2' and 3*a*2') of the rotary shaft 1, and are apt to be elastically restored later. Thus, the air flow generated by the elastic restoration is apt to be directed to the axially opposite end portions (2*a*2' and 3*a*2') and the axially central portion (2*a*3' and 3*a*3') of the rotary shaft 1, and to be well dispersed.

In addition, in the same manner as the conveyance members 2 and 3 according to the first to third embodiments, the length of each of the two conveyance members 2' and 3' from the axially central portion 2*a*1', 3*a*1' to each axially outer end portion 2*a*2' or 2*a*3', 3*a*2' or 3*a*3' becomes shorter than the length of the conventional conveyance member consisting of a sheet of film. Accordingly, the intensity of the air flow generated by the elastic restoration of the film is also relatively weaker in a direction of going farther from the axially central portion 2*a*1', 3*a*1' of each conveyance member 2', 3' toward each axially outer end portion 2*a*2' or 2*a*3', 3*a*2' or 3*a*3' thereof.

As a result, in the same manner as the developer conveyance member Gc according to the first to third embodiments, in the developer conveyance member Gc according to the fourth embodiment, the air flow is dispersed and weakened so that the toner can be relieved from being blown out violently in the axially opposite end portions of the rotary shaft 1, in comparison with the conventional developer conveyance member.

Accordingly, in the image forming apparatus U according to the fourth embodiment, the inside of each unit G', U2 or U, the sheet S or the like can be suppressed from being polluted by the toner blown out.

In addition, the film of the first conveyance member 2' is thicker than the film of the second conveyance member 3' so that the rigidity of the first conveyance member 2' is enhanced. Since the axially inner side 2*a*3' of the first conveyance member 2' is elastically deformed less and bent less than the axially inner side 3*a*3' of the second conveyance member 3' when a force is applied from the toner, the first conveyance member 2' is elastically restored earlier.

Accordingly, in the developer conveyance member Gc according to the fourth embodiment, when the rotary shaft 1 is rotated, the axially central portions 2*a*1' and 3*a*1' of the first and second conveyance members 2' and 3', the axially opposite end portions 2*a*2' and 3*a*2' of the first and second conveyance members 2' and 3', the axially inner side 2*a*3' of the first conveyance member 2' and the axially inner side 3*a*3' of the second conveyance member 3' are elastically restored in this order. As a result, in the image forming apparatus U according to the fourth embodiment, the timing of elastic restoration of each overlapping portion is dispersed, and the load of the toner on each overlapping portion is reduced. Thus, the toner can be further relieved from being blown out due to the elastic restoration of the respective conveyance members 2' and 3'.

Fifth Embodiment

Next, a fifth embodiment of the invention will be described. In the description of the fifth embodiment, constituent components corresponding to those in the first embodiment are referred to by the same numerals, and detailed description thereof will be omitted.

The fifth embodiment has the aforementioned configuration as the fifth embodiment, except the following points.

Figure 9:
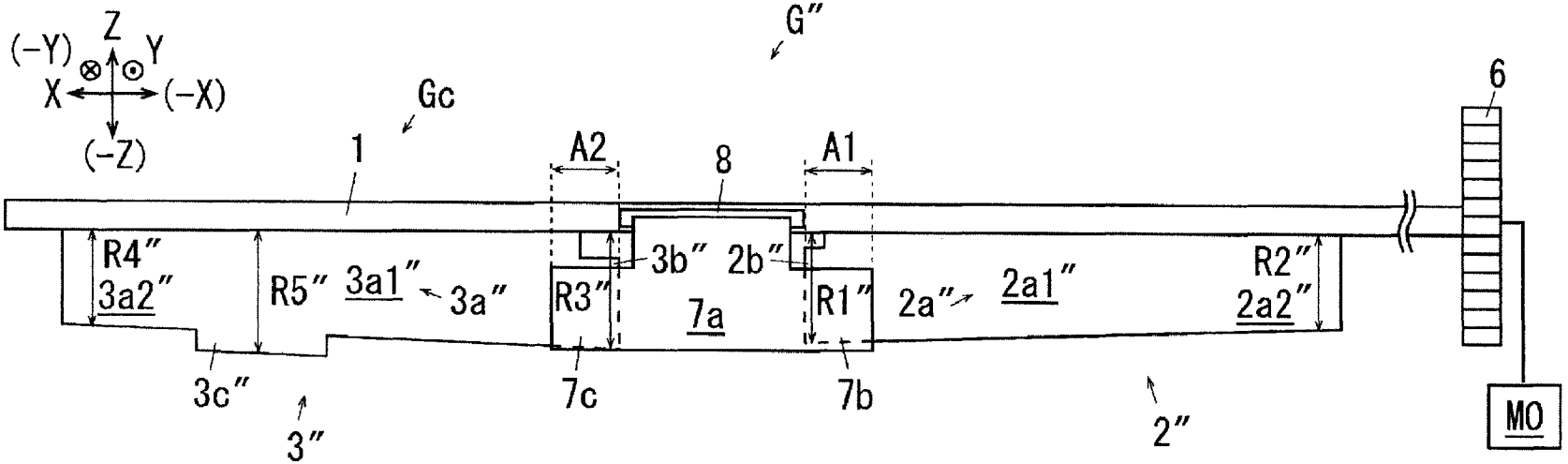
FIG. 9 is a view for explaining a developer conveyance member according to a fifth exemplary embodiment of the invention, corresponding to FIG. 3A showing the first exemplary embodiment.

FIG. 9 is a view for explaining a developer conveyance member according to the fifth embodiment of the invention. FIG. 9 is an explanatory view corresponding to FIG. 3A showing the first embodiment.

In FIG. 9, the developer conveyance member Gc according to the fifth embodiment has a first conveyance member 2", a second conveyance member 3" and a third conveyance member 7 in place of the conveyance members 2 and 3 in the second embodiment. The first conveyance member 2" is supported on the rotary shaft 1 so as to extend from the rear end thereof to the axially central portion thereof. The second conveyance member 3" is supported on the rotary shaft 1 so as to extend from the front end thereof to the axially central portion thereof. The third conveyance member 7 is supported on the axially central portion of the rotary shaft 1 and disposed between the conveyance members 2" and 3". Each conveyance member 2", 3", 7 according to the fifth embodiment is made of a flexible film in the same manner as each conveyance member 2, 3 according to the first embodiment.

In the same manner as the first conveyance member 2 according to the first embodiment, the first conveyance member 2" according to the fifth embodiment has a first conveyance member body 2*a*" and a first overlapping portion 2*b*". The first conveyance member body 2*a*" is fixedly supported on the rotary shaft 1 and located on the rear side. The first overlapping portion 2*b*" extends forward from the front end of the first conveyance member body 2*a*" and is designed to be movable relatively to the rotary shaft 1. On the other hand, in the same manner as the second conveyance member 3 according to the first embodiment, the second conveyance member 3" according to the fifth embodiment has a second conveyance member body 3*a*" and a second overlapping portion 3*b*". The second conveyance member body 3*a*" is fixedly supported on the rotary shaft 1 and located on the front side. The second overlapping portion 3*b*" extends rearward from the rear end of the second conveyance member body 3*a*" and is designed to be movable relatively to the rotary shaft 1. In addition, the second conveyance member 3" according to the fifth embodiment has a detection and cleaning portion 3*c*" which is similar to the detection and cleaning portion 3*c* of the second conveyance member 3 according to the first embodiment.

The third conveyance member 7 according to the fifth embodiment has a third conveyance member body 7*a* which is supported on the rotary shaft 1 with an elastic member 8 disposed in the axially central portion. In addition, the third conveyance member 7 has a first overlapped portion 7*b* and a second overlapped portion 7*c*. The first overlapped portion 7*b* extends rearward from the rear end of the third conveyance member body 7*a* and is designed to be movable relatively to the rotary shaft 1. The second overlapped portion 7*c* extends forward from the front end of the third conveyance member body 7*a* and is designed to be movable relatively to the rotary shaft 1.

According to the fifth embodiment, as shown in FIG. 9, the overlapping portions 2*b*" and 3*b*" are disposed adjacently to and on the right and left of the overlapped portions 7*b* and 7*c* respectively when the free end portions of the conveyance members 2", 3" and 7 are disposed on the lower side. That is, a first overlapping range A1 where the first overlapping portion 2*b*" and the first overlapped portion 7*b* overlap each other adjacently to each other and a second overlapping range A2 where the second overlapping portion 3*b*" and the second overlapped portion 7*c* overlap each other adjacently to each other are set in advance in the axially central portion of the rotary shaft 1 according to the fifth embodiment.

In the same manner as each conveyance member 2, 3 according to the first embodiment, each conveyance member 2", 3" according to the fifth embodiment is set in advance so that the radial length thereof decreases gradually in a direction of going farther from the axially central portion toward any of the axially opposite end portions. That is, the first and second conveyance members 2" and 3" are set in advance so that a relation of R1">R2">R0 and a relation of R3">R5">R4">R0 are established when R1" designates a radial length at the front end of the first conveyance member 2", R2" designates a radial length at the rear end of the first conveyance member 2", R3" designates a radial length at the rear end of the second conveyance member 3", R4" designates a radial length at the front end of the second conveyance member 3", and R5" designates a radial length of the detection and cleaning portion 3*c*". In the developer conveyance member Gc according to the fifth embodiment, the radial length of the third conveyance member 7 is set in advance to be as long as the radial length R1", R3" (R1"=R3") of each conveyance member 2", 3" all over the axial length of the third conveyance member 7.

A developing unit G" according to the fifth embodiment is constituted by the developing vessel V, the developing roll Ga, the inflow limiting member Gb, the developer conveyance member Gc, etc.

Operation of Fifth Embodiment

In the image forming apparatus U configured thus according to the fifth embodiment, when the rotary shaft 1 of the developer conveyance member Gc is rotated in response to an executed job, the toner is conveyed by each conveyance member 2", 3", 7, which has been brought into contact with the bottom surface 4 and bent all over its axial length. Here, the developer conveyance member Gc according to the fifth embodiment has three films supported on the rotary shaft 1, that is, the conveyance members 2", 3" and 7 shown in FIG. 9. The third conveyance member 7 is supported on the rotary shaft 1 with the elastic member 8 shown in FIG. 9 and disposed in the axially central portion. Accordingly, the third conveyance member 7 is designed in advance as follows. That is, when the third conveyance member 7 suffers a force from the toner, the elastic member 8 on its base end side is also elastically deformed to incline the third conveyance member 7 to the upstream side in the rotation direction to thereby make the third conveyance member 7 be delayed.

As a result, a phase delay in the rotation direction occurs between the third conveyance member 7 supported on the rotary shaft 1 with the elastic member 8 and each conveyance member 2", 3" supported directly on the rotary shaft 1. Due to the phase delay, the third conveyance member 7 delayed on the upstream side of the rotation direction is elastically restored later than the conveyance members 2" and 3".

That is, the third conveyance member 7 on the axially inner side of the rotary shaft 1 is elastically restored later than the conveyance members 2" and 3" on the axially opposite sides of the rotary shaft 1 when they are elastically restored. Accordingly, the air flow generated by the phase delay in the rotation direction among the films at the time of elastic restoration is also dispersed to the axially inner side of the rotary shaft 1, in comparison with the conventional developer conveyance member. Thus, the air flow is relieved from being concentrated in the axially opposite end portions.

As a result, in the image forming apparatus U according to the fifth embodiment, the toner is relieved from being blown out due to the elastic restoration, so that the inside of each unit G", U2 or U, the sheet S, etc. can be suppressed from being polluted by the toner.

In addition, according to the fifth embodiment, as shown in FIG. 9, the axially opposite end portions 2*a*2" and 2*b*", 3*a*2" and 3*b*", 7*b* and 7*c* of each film where the film is easily bent are disposed in the axially opposite end portions 2*a*2" and 2*b*", 3*a*2" and 3*b*", 7*b* and 7*c* of each conveyance member 2", 3", 7. Thus, the films can be easily bent not only in the axially opposite end portions (2*a*2" and 3*a*2") of the rotary shaft 1 but also in the overlapping ranges A1 and A2 on the axially inner sides (2*b*" with 7*b*, and 3*b*" with 7*c*). Accordingly, the axially inner sides (2*b*" with 7*b*, and 3*b*" with 7*c*) are bent as easily as the axially opposite end portions (2*a*2" and 3*a*2") of the rotary shaft 1, so as to be easily delayed on the upstream side of the rotation direction. Thus, the air flow generated by the phase delay in the rotation direction between the axially central portion and each of the axially opposite end portions in each film when the film is elastically restored is easily directed from the axially central portion 2*a*1", 3*a*1", 7*a* of each conveyance member 2", 3", 7 toward the axial opposite end portions (2*a*2" and 3*a*2") and the axially inner side (2*b*" with 7*b*, 3*b*" with 7*c*) where each overlapping range A1, A2 is disposed. Thus, the air flow can be dispersed easily.

In addition, in comparison with the conventional conveyance member consisting of a sheet of film, each of the three conveyance members 2", 3" and 7 has a shorter distance between the axially central portion 2*a*1", 3*a*1", 7*a* and each axially outer end portion 2*a*2" or 2*b*", 3*a*2" or 3*b*", 7*b* or 7*c*. Accordingly, in the same manner as in the first to fourth embodiments, the intension of the air flow is also relatively weak.

Further, according to the fifth embodiment, the overlapping portions 2*b*", 3*b*", 7*b* and 7*c* disposed in the overlapping ranges A1 and A2 are designed to be movable relatively to the rotary shaft 1. Thus, each overlapping portion 2*b*", 3*b*", 7*b*, 7*c* is apt to be delayed on the upstream side of the rotation direction in a direction of going farther from each conveyance member body 2*a*", 3*a*", 7*a*.

Accordingly, in the same manner as in the first to fourth embodiments, the air flow in the developer conveyance member Gc according to the fifth embodiment is dispersed and weakened in comparison with the conventional developer conveyance member. Thus, the toner is relieved from being blown out violently in the axially opposite end portions of the rotary shaft 1.

As a result, in the image forming apparatus U according to the fifth embodiment, the inside of each unit G", U2 or U, the sheet S, etc. can be relieved from being polluted by the toner blown out, in the same manner as in the first to fourth embodiments.

(Modifications)

The embodiments of the invention have been described above in detail. However, the invention is not limited to the embodiments, but can be changed variously within the gist of the invention stated in the scope of claims. Modifications (H01) to (H010) of the invention will be shown below by way of example.

(H01) The invention is not limited to printers but can be applied to image forming apparatus such as copying machines, facsimile machines, complex machines, etc.

(H02) In the developer conveyance member Gc according to the aforementioned embodiments, each conveyance member 2, 3, 2', 3', 2", 3", 7 is formed into a trapezoidal shape so that the relations of R1>R2>R0 and R3>R5>R4>R0, the relations of R1'>R2'>R0 and R3'>R5'>R4'>R0, or the relations of R1">R2">R0 and R3">R5">R4">R0 are established among the radial lengths R1-R5, R1'-R5' or R1"-R5" of the conveyance members 2 and 3, 2' and 3', or 2", 3" and 7, so that the toner conveyed and unevenly distributed to the axially opposite end portions is brought to the axially inner side to be thereby conveyed uniformly all over the axial length. However, the invention is not limited thereto. For example, each conveyance member 2, 3, 2', 3', 2", 3", 7 may be formed into a rectangular shape while a slit is formed obliquely between the free end portion and the base end portion. In this manner, similar operation and effect can be obtained.

(H03) In the first to third embodiments, the first overlapping portion 2*b* of the first conveyance member 2 of the developer conveyance member Gc is formed to extend axially. However, the invention is not limited thereto. For example, the first overlapping portion 2*b* may be formed obliquely to extend from the upstream side of the rotary shaft toward the downstream side of the rotary shaft so that the distance from the first overlapping portion 2*b* to the rotary shaft increases gradually in a direction of going farther from the rear end toward the front end. In this case, it is possible to elongate the time since the first overlapping portion 2*b* reaches the boundary 4*a* and till the second overlapping portion 3*b* reaches the boundary 4*a*.

(H04) In the fourth embodiment, the bending magnitude of a film of each conveyance member 2', 3' is adjusted by increasing the thickness of the film. However, the invention is not limited thereto. For example, the material of each film may be changed to adjust the magnitude of bending of the film. In addition, in the same manner as in the fourth embodiment, the magnitude of bending of one of the films of the conveyance members 2 and 3 or 2", 3" and 7 of the developer conveyance member Gc according to the first to third and fifth embodiments can be adjusted by changing the thickness of the film or changing the material of the film.

(H05) In the second to fourth embodiments, the protrusion portion 4*b* or 4*b*' is formed in the axially central portion. However, the invention is not limited thereto. The protrusion portion 4*b* or 4*b*' may be formed in a desired axial position. In addition, the number of protrusion portions 4*b* or 4*b*' is not necessarily limited to one, but a plurality of protrusion portions may be formed.

(H06) In the fifth embodiment, the protrusion portion 4*b* or 4*b*' according to the second to fourth embodiments may be formed in the bottom surface 4. Also in this case, the operation and effect of the invention can be obtained.

(H07) The conveyance members 2 and 3 or 2' and 3' of the developer conveyance member Gc are made of two films in the first to fourth embodiments, and the conveyance members 2", 3" and 7 of the developer conveyance member Gc are made of three films in the fifth embodiment. However, the invention is not limited thereto. For example, conveyance members of the developer conveyance member Gc may be made of four or more films. Also in this case, the operation and effect of the invention can be obtained.

(H08) In the embodiments, it is preferable that the driving gear 6 is disposed on the rear side of the first conveyance member 2, 2', 2" where elastic restoration will be performed earlier. However, the driving gear 6 may be disposed on the front side of the second conveyance member 3, 3', 3" where elastic restoration will be performed later.

(H09) A notch, i.e. a so-called slit, extending axially inward from an axially outer end portion can be formed in each conveyance member 2, 3, 2', 3', 2", 3", 7 in each embodiment. In this case, the rotation-direction phase of each of the axially opposite end portions can be delayed on the upstream side of the rotation direction with respect to the axially central portion in each portion between each of the axially opposite end portions and the slit in each conveyance member. Thus, the flow of the air generated when each conveyance member is restored from a bent state can be dispersed so that the toner can be relieved from being blown out violently in the axially opposite end portions of the rotary shaft 1, in comparison with the case where the slit is not provided.

(H010) In each embodiment, it is preferable that each overlapping portion 2*b*, 2*b*", 3*b*" which will be elastically restored earlier is not supported on the rotary shaft 1 but is designed to be movable relatively to the rotary shaft 1 in the same manner as each overlapping portion 3*b*, 7*b*, 7*c* which will be elastically restored later. However, the operation and effect of the invention can be obtained even if each overlapping portion 2*b*, 2*b*", 3*b*" is supported on the rotary shaft 1. On the contrary, even if each overlapping portion 2*b*, 2*b*", 3*b*" which will be elastically restored earlier is not supported on the rotary shaft 1 but is designed to be movable relatively to the rotary shaft 1 while only each overlapping portion 3*b*, 7*b*, 7*c* which will be elastically restored later is supported on the rotary shaft 1, the operation and effect of the invention can be obtained. In this case, when a large load is applied from toner to each overlapping range A, A1, A2 of each overlapping portion (2*b*, 3*b*), (2*b*", 7*b*), (3*b*", 7*c*), the toner can be relieved from being blown out due to the elastic restoration of each overlapping portion 2*b*, 2*b*", 3*b*", and each film can be prevented from being excessively bent due to each overlapping portion 3*b*, 7*b*, 7*c* to thereby excessively lower the toner conveyance ability in each overlapping range A, A1, A2.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developing unit comprising:

a developer receiving vessel that comprises a developer receiving chamber and a retainer receiving chamber, the developer receiving chamber receiving a developer, the retainer receiving chamber supporting a developer retainer and being connected to the developer receiving chamber, the developer retainer rotating while retaining the developer on a surface of the developer retainer; and a developer conveyance member that is disposed in the developer receiving chamber and conveys the developer in the developer receiving chamber toward the developer retainer, the developer conveyance member comprising:

a rotary shaft that extends along the developer conveyance member;

a first conveyance member that extends from one axial end of a predetermined overlapping range on an axially inner side of the rotary shaft to the other axial end of the rotary shaft and that has flexibility, the first conveyance member being supported on the rotary shaft and bent in contact with a wall surface of the developer receiving chamber with rotation of the rotary shaft while conveying the developer toward the developer retainer, the first conveyance member comprising a first overlapping portion corresponding to the overlapping range; and a second conveyance member that extends from the other axial end of the overlapping range to the one axial end of the rotary shaft and that has flexibility, the second conveyance member being supported on the rotary shaft and bent in contact with the wall surface of the developer receiving chamber with rotation of the rotary shaft while conveying the developer toward the developer retainer, the second conveyance member comprising a second conveyance member body supported on the rotary shaft and located out of the overlapping range, and a second overlapping portion extending from the second conveyance member body to the other axial end of the overlapping range, the second overlapping portion being designed to be unfixable relative to the rotary shaft and disposed adjacent to an upstream side of the first overlapping portion in a rotation direction.

2. The developing unit according to claim 1, wherein the first conveyance member comprises a first conveyance member body and the first overlapping portion, the first conveyance member body being supported on the rotary shaft and being located out of the overlapping range, the first overlapping portion extending from the first conveyance member body to the one axial end of the overlapping range, being designed to be movable relative to the rotary shaft and being disposed adjacent to a downstream side of the second overlapping portion in the rotation direction.

3. The developing unit according to claim 2, wherein the first overlapping portion is disposed obliquely to extend from the upstream side of the rotary shaft toward the downstream side of the rotary shaft so that a distance from the first overlapping portion to the rotary shaft increases gradually in a direction of going farther from the other axial end of the overlapping range toward the one axial end thereof.

4. The developing unit according to claim 1, wherein the second overlapping portion is disposed obliquely to extend from the downstream side of the rotary shaft toward the upstream side of the rotary shaft so that a distance from the second overlapping portion to the rotary shaft increases gradually in a direction of going farther from the one axial end of the overlapping range toward the other axial end thereof.

5. The developing unit according to claim 1, wherein the second conveyance member is formed by extending the one axial end portion of the second overlapping portion to the other axial end portion of the second conveyance member body located out of the overlapping range.

6. The developing unit according to claim 1, wherein the developer receiving chamber has a protrusion portion extending from a connection portion between the developer receiving chamber and the retainer receiving chamber toward the upstream side of the rotation direction, the protrusion portion being formed in a position corresponding to an axially inner portion of the rotary shaft.

7. The developing unit according to claim 6, wherein the developer receiving chamber is formed so that height of the protrusion portion increases gradually in a direction of going farther from the upstream side of the rotation direction toward the downstream side of the rotation direction.

8. The developing unit according to claim 6, wherein the protrusion portion of the developer receiving chamber is formed in a position corresponding to the overlapping range.

9. The developing unit according to claim 1, wherein each of the conveyance members is made of a thin film member, and each of the conveyance members extends radially outward from the rotary shaft and has a notch extending radially inward from a radially outer end portion of the thin film member.

10. An image retainer unit comprising:

an image retainer on whose surface a latent image is formed; and the developing unit according to claim 1, that develops the latent image on the surface of the image retainer into a visible image.

11. An image forming apparatus comprising:

an image retainer on whose surface a latent image is formed;

the developing unit according to claim 1, that develops the latent image on the surface of the image retainer into a visible image;

a transferer that transfers the visible image on the surface of the image retainer onto a medium; and a fixing unit that fixes the visible image on a surface of the medium.

12. A developing unit comprising:

a developer receiving vessel that comprises a developer receiving chamber and a retainer receiving chamber, the developer receiving chamber receiving a developer, the retainer receiving chamber supporting a developer retainer and being connected to the developer receiving chamber, the developer retainer rotating while retaining the developer on a surface of the developer retainer; and a developer conveyance member that is disposed in the developer receiving chamber and conveys the developer in the developer receiving chamber toward the developer retainer, the developer conveyance member comprising:

a rotary shaft that extends along the developer conveyance member;

a first conveyance member that extends to one axial end of the rotary shaft from the other axial end of a predetermined first overlapping range in an axially inner portion of the rotary shaft and that has flexibility, the first conveyance member being supported on the rotary shaft and bent in contact with a wall surface of the developer receiving chamber with rotation of the rotary shaft while conveying the developer toward the developer retainer, the first conveyance member comprising a first overlapping portion corresponding to the first overlapping range; and a second conveyance member that extends to the other axial end portion of the rotary shaft from the one axial end of a second overlapping range and that has flexibility, the second overlapping range being set in advance in a position located in the axially inner portion of the rotary shaft and at a distance from the other axial end side of the first overlapping range, the second conveyance member being supported on the rotary shaft and bent in contact with the wall surface of the developer receiving chamber with rotation of the rotary shaft while conveying the developer toward the developer retainer, the second conveyance member comprising a second overlapping portion corresponding to the second overlapping range; and a third conveyance member that extends to the other axial end of the second overlapping range from the axial one end of the first overlapping range and that has flexibility, the third conveyance member being supported on the rotary shaft and bent in contact with the wall surface of the developer receiving chamber with rotation of the rotary shaft while conveying the developer toward the developer retainer, the third conveyance member comprising a third conveyance member body, a first overlapped portion and a second overlapped portion, the third conveyance member body being supported on the rotary shaft and located out of the first and second overlapping ranges, the first overlapped portion extending from the third conveyance member body to the one axial end of the first overlapping range, being designed to be movable relative to the rotary shaft and being disposed adjacent to the upstream side of the first overlapping portion in the rotation direction, the second overlapped portion extending from the third conveyance member body to the other axial end of the second overlapping range, being designed to be movable relative to the rotary shaft and being disposed adjacent to the upstream side of the second overlapping portion in the rotation direction.

13. The developing unit according to claim 12, wherein the third conveyance member body is supported on the rotary shaft with an elastic member.

14. The developing unit according to claim 12, wherein the first conveyance member comprises a first conveyance member body and the first overlapping portion, the first conveyance member body being supported on the rotary shaft and being located out of the first overlapping range, the first overlapping portion extending from the first conveyance member body to the other axial end of the first overlapping range, being designed to be movable relative to the rotary shaft and being disposed adjacent to the downstream side of the first overlapped portion in the rotation direction; and the second conveyance member comprises a second conveyance member body and the second overlapping portion, the second conveyance member body being supported on the rotary shaft and being located out of the second overlapping range, the second overlapping portion extending from the second conveyance member body to the one axial end of the second overlapping range, being designed to be movable relative to the rotary shaft and being disposed adjacent to the downstream side of the second overlapped portion in the rotation direction.

15. A developing unit comprising:

a developer receiving vessel that comprises a developer receiving chamber and a retainer receiving chamber, the developer receiving chamber receiving a developer, the retainer receiving chamber supporting a developer retainer and being connected to the developer receiving chamber, the developer retainer rotating while retaining the developer on a surface of the developer retainer; and a developer conveyance member that is disposed in the developer receiving chamber and conveys the developer in the developer receiving chamber toward the developer retainer, the developer conveyance member comprising:

a rotary shaft that extends along the developer retainer;

a first conveyance member that extends from one axial end of a predetermined overlapping range on an axially inner side of the rotary shaft to the other axial end of the rotary shaft and that has flexibility, the first conveyance member being supported on the rotary shaft and bent in contact with a wall surface of the developer receiving chamber with rotation of the rotary shaft while conveying the developer toward the developer retainer, the first conveyance member comprising a first overlapping portion corresponding to the overlapping range;

a second conveyance member that extends from the other axial end of the overlapping range to the one axial end of the rotary shaft and that has flexibility, the second conveyance member being supported on the rotary shaft and bent in contact with the wall surface of the developer receiving chamber with rotation of the rotary shaft while conveying the developer toward the developer retainer, the second conveyance member comprising a second conveyance member body supported on the rotary shaft and located out of the overlapping range, and a second overlapping portion extending from the second conveyance member body to the other axial end of the overlapping range, designed to be movable relative to the rotary shaft and disposed adjacent to an upstream side of the first overlapping portion in a rotation direction; and wherein the second overlapping portion is disposed obliquely to extend from the downstream side of the rotary shaft toward the upstream side of the rotary shaft so that a distance from the second overlapping portion to the rotary shaft increases gradually in a direction of going farther from the one axial end of the overlapping range toward the other axial end thereof.

* * * * *